US009169062B2

(12) United States Patent
Reece et al.

(10) Patent No.: US 9,169,062 B2
(45) Date of Patent: Oct. 27, 2015

(54) LOCK HOPPER MASS FLOW ARRANGEMENT

(75) Inventors: Edwin V. Reece, Missouri City, TX (US); John Abughazaleh, Sugar Land, TX (US); Michael J. Sandefur, Baytown, TX (US); David P. Mann, Katy, TX (US)

(73) Assignee: KELLOGG BROWN & ROOT LLC, Houston, TX (US)

( * ) Notice: Subject to any disclaimer, the term of this patent is extended or adjusted under 35 U.S.C. 154(b) by 1025 days.

(21) Appl. No.: 13/173,231

(22) Filed: Jun. 30, 2011

(65) Prior Publication Data

US 2013/0004247 A1 Jan. 3, 2013

(51) Int. Cl.

| | |
|---|---|
| ***B65G 53/38*** | (2006.01) |
| ***B65D 88/64*** | (2006.01) |
| ***B65D 88/70*** | (2006.01) |

(52) U.S. Cl.

CPC ..... *B65D 88/64* (2013.01); *B65D 88/70* (2013.01)

(58) Field of Classification Search

USPC ..... 406/136, 137, 138, 146; 222/195, 460; 239/143

See application file for complete search history.

(56) References Cited

U.S. PATENT DOCUMENTS

| | | | | | |
|---|---|---|---|---|---|
| 1,484,599 | A | | 2/1924 | Whitaker | |
| 2,530,689 | A | * | 11/1950 | Egger et al. | 406/144 |
| 2,604,238 | A | | 7/1952 | Osgood | |
| 2,732,944 | A | * | 1/1956 | Hays | 210/220 |
| 3,027,870 | A | | 4/1962 | Schirmer | |
| 3,189,061 | A | * | 6/1965 | Stockel et al. | 141/68 |
| 3,194,539 | A | * | 7/1965 | Hanne-Wiame | 406/94 |
| 3,218,175 | A | * | 11/1965 | Siegel et al. | 426/416 |
| 3,223,457 | A | * | 12/1965 | Albert | 406/138 |
| 3,350,995 | A | | 11/1967 | Jeru | |
| 3,366,282 | A | * | 1/1968 | Lucas | 222/195 |
| 3,587,936 | A | | 6/1971 | Riotto | |
| 3,841,530 | A | * | 10/1974 | Janninck | 222/189.04 |
| 3,854,634 | A | * | 12/1974 | Hart | 406/136 |
| 4,253,955 | A | * | 3/1981 | Kline | 210/172.1 |
| 4,262,603 | A | * | 4/1981 | Morse | 105/310 |
| 4,342,345 | A | * | 8/1982 | Nadin et al. | 141/392 |
| 4,538,692 | A | * | 9/1985 | Henry et al. | 177/1 |
| 4,553,698 | A | * | 11/1985 | Parker et al. | 239/3 |
| 4,869,622 | A | | 9/1989 | Salter et al. | |
| 4,872,598 | A | * | 10/1989 | Travis | 222/630 |

(Continued)

FOREIGN PATENT DOCUMENTS

| | | |
|---|---|---|
| DE | 19729535 | 7/1998 |
| EP | 2253563 | 11/2010 |

(Continued)

*Primary Examiner* — Joseph Dillon, Jr.
(74) *Attorney, Agent, or Firm* — Gary M. Machetta

(57) ABSTRACT

Methods, systems, and apparatus for mass flow are provided. The apparatus can include a housing, an inlet disposed at a first end of the housing, and an outlet disposed at a second end of the housing. The housing can include a first section and a second section. The second section can have at least one tapered sidewall that slopes away from an inner surface of the first section toward the outlet. The apparatus can also include a divider disposed at least partially within the first and second sections of the housing. The divider can have at least one tapered surface disposed proximate the at least one tapered sidewall of the second section. An edge of the divider can be located between the outlet and a point within the second section where the cross-sectional area of the second section is about three times or less a cross-sectional area of the outlet.

10 Claims, 6 Drawing Sheets

(56) References Cited

U.S. PATENT DOCUMENTS

| | | | | | |
|---|---|---|---|---|---|
| 4,941,779 | A | * | 7/1990 | Dewitz et al. | 406/138 |
| 4,948,013 | A | * | 8/1990 | Thomas et al. | 222/1 |
| 4,971,259 | A | * | 11/1990 | Nidiffer | 241/34 |
| 5,129,766 | A | | 7/1992 | Dirkse et al. | |
| 5,143,256 | A | * | 9/1992 | Wadensten | 222/3 |
| 5,245,949 | A | * | 9/1993 | Hively | 119/53 |
| 5,248,197 | A | | 9/1993 | Storf | |
| 5,405,219 | A | * | 4/1995 | Wang | 406/146 |
| 5,441,176 | A | * | 8/1995 | Auee | 222/163 |
| 5,454,490 | A | | 10/1995 | Johanson | |
| 5,462,351 | A | * | 10/1995 | Royal | 366/101 |
| 7,392,624 | B2 | | 7/2008 | Kinzer | |
| 2002/0166861 | A1 | * | 11/2002 | Hinkle et al. | 220/562 |
| 2011/0001265 | A1 | * | 1/2011 | Walia et al. | 264/299 |
| 2011/0002736 | A1 | * | 1/2011 | Monger et al. | 404/75 |

FOREIGN PATENT DOCUMENTS

| | | |
|---|---|---|
| GB | 262125 | 5/1927 |
| GB | 1161473 | 8/1969 |
| GB | 1278358 | 6/1972 |
| GB | 1305149 | 1/1973 |
| GB | 2136407 | 9/1984 |

* cited by examiner

LOCK HOPPER MASS FLOW ARRANGEMENT

BACKGROUND

1. Field

Embodiments described herein generally relate to particulate flow through a vessel or housing. More particularly, such embodiments relate to maintaining particulate flow through a vessel or housing.

2. Description of the Related Art

As particles or particulates flow through vessels or housings, such as lock hoppers or silos for carbonaceous material, particulate bridging can occur proximate an outlet to the vessel. Particulate bridging can temporarily or permanently block mass flow through the vessel. The likelihood of particulate bridging is particularly pronounced between angled walls of the vessel where the cross-sectional area of the vessel narrows, such as near an outlet.

There is a need, therefore, for new apparatus and methods for reducing or preventing particulate bridging and/or maintaining particulate flow through a vessel.

DETAILED DESCRIPTION

Methods, systems, and apparatus for mass flow are provided. The apparatus can include a housing, an inlet disposed at a first end of the housing, and an outlet disposed at a second end of the housing. The housing can include a first section and a second section. The second section can have at least one tapered sidewall that slopes away from an inner surface of the first section toward the outlet. The apparatus can also include a divider disposed at least partially within the first and second sections of the housing. The divider can have at least one tapered surface disposed proximate the at least one tapered sidewall of the second section. An edge of the divider can be located between the outlet and a point within the second section where the cross-sectional area of the second section is about three times or less a cross-sectional area of the outlet.

Figure 1:
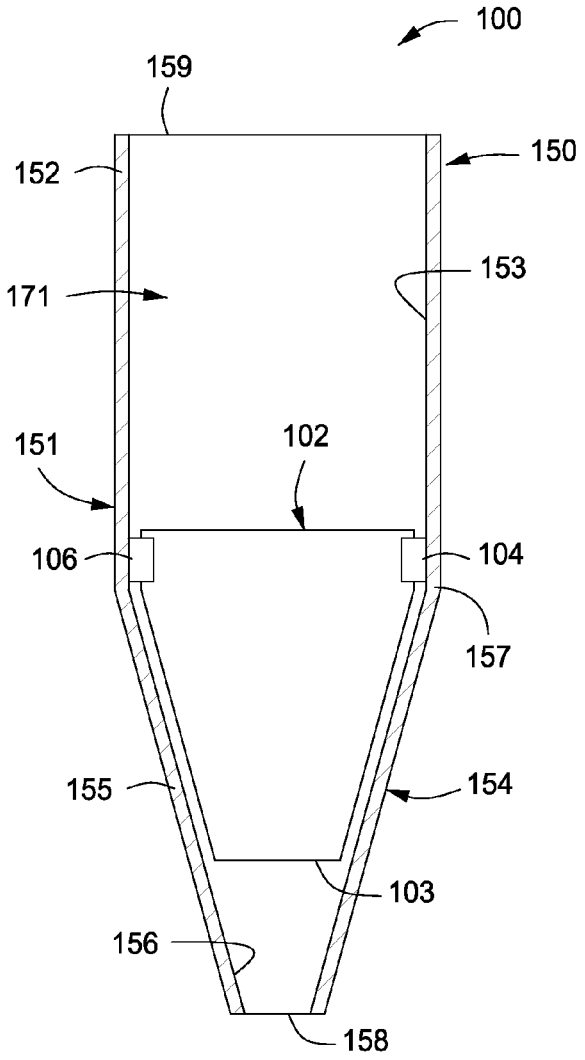
FIG. 1 depicts a cross-section view of an illustrative apparatus for reducing or preventing particulate bridging within a housing thereof, according to one or more embodiments described.

FIG. 1 depicts a cross-section view of an illustrative apparatus 100 for reducing or preventing particulate bridging within a housing 150 thereof, according to one or more embodiments. The apparatus 100 can include one or more dividers or partitions 102 disposed within an internal volume 171 of the housing 150. The housing 150 can have a first or "upper" section 151 and a second or "lower" section 154 that at least partially define the internal volume 171 within the housing 150.

The upper section 151 can have various cross-sectional shapes including, but not limited to, circular, elliptical, oval, rectangular, triangular, trapezoidal, pentagonal, hexagonal, or any geometrical shape or any combination thereof. The upper section 151 can include one or more first or "upper" walls or sidewalls 152 that can be substantially parallel to a central axis of the housing 150. The upper wall 152 can include one or more inner or interior sides or surfaces 153. An inlet 159 to the housing 150 can be defined in the upper section 151. For example, the inlet 159 can be an opening defined by the upper wall 152. In another example, the inlet 159 can be defined by a flange or cap disposed on an end of the upper wall 152.

The lower section 154 can transition or taper from a cross-sectional area of the upper section 151 to a reduced cross-sectional area at an outlet 158 thereof. For example, a cross-sectional area of the upper section 151 can be more than about 1.1, about 1.3, about 1.5, about 1.8, about 2, about 3, about 4, or about 5 times a cross-sectional area of the outlet 158 of the lower section 154. In another example, the cross-sectional area of the upper section 151 can range from about 1.2 to about 4.5, about 1.4 to about 3.5, or about 1.6 to about 2.5 times the cross-sectional area of the outlet 158. The cross-sectional area of the outlet 158 can be determined by shear cell testing of the material to be used in the housing 150.

The lower section 154 can have the same or different cross-sectional shape as the upper section 151, albeit with at least a portion thereof having a reduced or reducing cross-sectional area. For example, the lower section 154 can have the same cross-sectional area at a transition 157 as the cross-sectional area of the upper section 151 and a smaller cross-sectional area toward the outlet 158. The lower section 154 can include one or more second or "lower" walls or sidewalls 155, where the upper wall 152 is disposed on or transitions to the lower wall 155. The lower wall 155 can taper toward the outlet 158. For example, one or more inner or interior sides or surfaces 156 of the lower wall 155 can slope inwardly and/or away from the one or more inner surfaces 153 of the upper wall 152 toward the outlet 158. In another example, at least one of the one or more inner surfaces of the lower wall 155 can have an angle ranging from a low of about 60°, about 65°, about 70° to a high of about 75°, about 80°, about 85°, with respect to at least one of the one or more inner surfaces of the upper wall 152 and/or a longitudinal central axis of the housing 150. The one or more inner surfaces 153 of the upper wall 152 can be a cylindrical inner surface and the one or more inner surfaces 156 of the lower wall 155 can be a frustoconical inner surface.

In a specific example, the upper section 151 can be cylindrical and the lower section 154 can be frustoconical, having a first diameter where the lower section 154 joins the upper section 151 and a second diameter at the outlet 158, where the first diameter is larger than the second diameter. For example, the first diameter can be more than about 1.2, about 1.5, about 1.8, about 2, about 3, about 4, or about 5 times larger than the second diameter.

The divider 102 can be or include one or more plates or sheets and can be positioned within the internal volume 171 of the housing 150 to reduce or prevent the occurrence of particulate bridging therein. For example, the divider 102 can be disposed within the internal volume 171 of the housing 150 and can be positioned proximate the transition 157 from the upper section 151 to the lower section 154. For example, the divider 102 can be a single plate axially oriented with respect to the housing 150, and can at least partially extend from the upper section 151 into the lower section 154. A bottom or lower edge 103 of the divider 102 can extend into the lower section 154 about 5% or more, about 10% or more, about 20% or more, about 30% or more, about 40% or more, about 50% or more, about 60% or more, about 70% or more, about 80% or more of a total length or height of the lower section 154. For example, the lower edge 103 of the divider 102 can extend about halfway or more into the lower section 154. In another example, the lower edge 103 of the divider 102 can be located between the outlet 158 and a point within the second section 154 where the cross-sectional area of the second section 154 is about three times or less the cross-sectional area of the outlet 158. In yet another example, the lower edge 103 of the divider 102 can extend to a point or location within the lower section 154 where the cross-sectional area of the lower section 154 is about 2.5, about 2.7, about 2.9, about 3, about 3.1, about 3.3, or about 3.5 times that of the outlet 158. In another example, the lower edge 103 of the divider 102 can extend into the lower section 154 to the extent that a cross-sectional area of a divided portion between the divider 102 and the lower wall 155 of the lower section 154 is greater than or equal to the cross-sectional area of the outlet 158. In still another example, the lower edge 103 of the divider 102 can extend to a point or location within the lower section 154 where a ratio of the cross-sectional area of the lower section 154 to the cross-sectional area of the outlet 158 is about 3:1 or less, about 2.5:1 or less, about 2:1 or less, or about 1.5:1 or less.

The divider 102 can extend from one side of the one or more inner surfaces 153 of the upper wall 152 and/or the one or more inner surfaces 156 the lower wall 155 to at least partially segregate or partition at least a portion of the housing 150. The divider 102 can extend in a radial direction with respect to a central longitudinal axis of the housing 150 between a first location and a second location on the one or more inner surfaces 153 of the upper wall 152. In another example, a first edge or side of the divider 102 can be disposed on or proximate to a first location on the one or more inner surfaces 153 of the upper wall 152 and a second edge or side can be disposed on or proximate to a second location on the one or more inner surfaces 153 of the upper wall 152. In another example, a first edge or side of the divider 102 can be disposed on or proximate to a first location on the one or more inner surfaces 156 of the lower wall 155 and a second edge or side can be disposed on or proximate to a second location on the one or more inner surfaces 156 of the lower wall 155. In another example, a first edge or side of the divider 102 can be disposed on or proximate to a first location on the one or more inner surfaces 153 of the upper wall 152 and a second edge or side can be disposed on or proximate to a second location on the one or more inner surfaces 156 of the lower wall 155.

The divider 102 can be configured to have edges that fit or rest in one or more brackets or guides (two are shown 104, 106) disposed on the inner surface 153 of the upper wall 152, the inner surface 156 of the lower wall 155, and/or both. For example, the divider 102 can be a flat plate having a first width approximately corresponding with a cross-sectional length of the upper section 151 (e.g., the first diameter when the upper section 151 is cylindrical). The width of the flat plate can taper or transition to a second width approximately corresponding with a second cross-sectional length (e.g., the second diameter in the lower section 154 or a third diameter in-between the first and second diameters, when the lower section 154 is frustoconical). For example, the divider 102 can be an irregular hexagon shaped plate having a top and bottom edge substantially perpendicular to the inner surface 153 of the upper wall 152 of the upper section 151 (i.e., radially oriented with respect to the inner surface of the upper wall 152), at least two edges substantially parallel with the inner surface 153 of the upper wall 152 of the upper section 151, and/or at least two edges substantially parallel with the sloped inner surface 156 of the lower wall 155 of the lower section 154. In another example, the top and bottom edge of the divider 102 can be parallel to one another. The divider 102 can have at least one tapered surface disposed proximate the tapered or sloped inner surface 156 of the lower wall 155 of the second section 154. Although the divider 102 is illustrated as having six sides or edges, it will be appreciated that the divider 102 can instead be, but is not limited to, a triangle, rectangle, trapezoid, parallelogram, pentagon, heptagon, octagon, or other polygonal shape. The divider 102 can also be elliptical, circular, semi-elliptical, semi-circular, or amorphous. In another example, the divider 102 can have from 3 to 100 sides.

The divider 102 can be made from suitable metals, metal alloys, composite materials, polymeric materials, combinations thereof, or the like. For example, the divider 102 can be made from a metal alloy including, but not limited to, nickel, iron, chromium, cobalt, silicon, manganese, molybdenum, titanium, carbon, tungsten, columbium, or a combination thereof. In another example, the divider 102 can be made from steel or stainless steel alloys such as 310SS, 304SS, 800H, Haynes 120, Haynes 160, Haynes 556, low chrome alloys, carbon steel, or the like. In yet another example, the divider 102 can be a stainless steel plate. In addition, the divider 102 can have be polished, finished, or otherwise smoothed to minimize friction between particulates and the divider 102 within the housing 150 and/or to limit or reduce adhesion or sticking of particulates to the divider 102. For example, the divider 102 can have a 2B finish. The divider 102 can have a thickness ranging from a low of about 0.5 cm, about 1 cm, or about 1.5 cm to a high of about 2 cm, about 2.5 cm, or about 3 cm. For example, the divider 102 can have a thickness of about 0.75 cm to about 2.75 cm or about 1.25 cm to about 2.25 cm.

As illustrated, the first and second guides 104, 106 can be disposed on or otherwise secured to the inner surface 153 of the upper wall 152 of the upper section 151 proximate the transition 157 from the upper section 151 to the lower section 154. It will be appreciated, however, that the guides 104, 106 and/or additional guides (not shown) can be disposed on the inner surface 156 of the lower wall 155 of the lower section 154. Although not shown, it will also be appreciated that the apparatus 100 can be free of any guides. The first and second guides 104, 106 can be secured or fastened to the housing 150 or walls thereof 152, 155 by one or more welds, nuts and bolts, rivets, screws, nails, epoxy, any other suitable fastener, or any combination thereof. The first and second guides 104, 106 can at least partially uphold, align, and/or support the divider 102. The first and second guides 104, 106 can also at least partially prevent the divider 102 from being dislodged during operation of apparatus 100.

The housing 150 can be configured to contain particulates therein and/or to have the particulates flow therethrough. The particulates can be in the form of beads, pellets, flakes, spheres, cubes, fibers, blocks, rods, filaments, randomly crushed or ground particles, granules, or any combination thereof. For example, the particulates can be carbonaceous material, grains, sand, or the like. In another example, the particulates can be pulverized, crushed, or ground coal, e.g., lignite. Coal fed to the housing 150 can be dried and ground. For example, coal fed to the housing 150 can have a moisture content ranging from about 18% to about 35%. The size of the particulates can range from a low of about 1 μm, about 100 μm, about 200 μm, or about 300 μm, to about 400 μm, about 500 μm, about 1000 μm, or about 2,000 μm. In another example, the size of the particulates can range from about 45 μm to about 1,500 μm, about 150 μm to about 750 μm, about 250 μm to about 450 μm, or about 350 μm to about 550 μm. Particulates within the housing 150 can flow at various rates depending, at least partially, on the particulate size, viscosity, and/or friction between the particulates, and the size of the internal volume 171 of the housing 150. For example, with the divider 102 disposed in the housing 150, the average flow rate of the particulates through the housing 150 can range from a low of about 50 kg per hour ("kg/hr"), about 55 kg/hr, or about 60 kg/hr to a high of about 65 kg/hr, about 70 kg/hr, or about 75 kg/hr. In another example, the flow rate can range from a low of about 1 kg/hr, about 5 kg/hr. or about 10 kg/hr to a high of about 90 kg/hr, about 95 kg/hr, or about 100 kg/hr.

Figure 2:
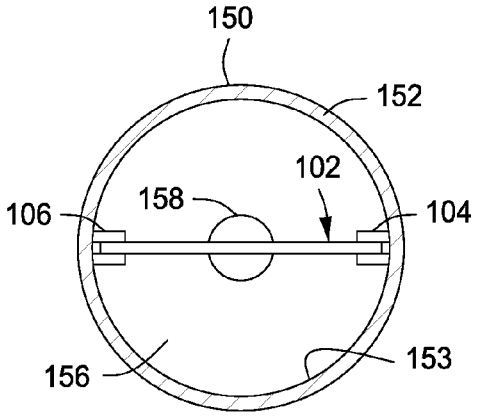
FIG. 2 depicts a top view of the apparatus depicted in FIG. 1.

FIG. 2 depicts a top view of the apparatus 100 depicted in FIG. 1. An edge of the divider 102 can be radially disposed or oriented in the housing 150 between the guides 104, 106. The guides 104, 106 can be configured to maintain the orientation of the divider 102. For example, each of the guides 104, 106 can include one or more plates or portions disposed on or protruding from the one or more inner surfaces 153 of the upper wall 152, the one or more inner surfaces 156 of the lower wall 155, or both. In another example, the guides 104, 106 can each include two plates or portions disposed on or protruding from the inner surface 153 of the upper wall 152, the inner surface 156 of the lower wall 155, or both. In another example, each of the guides 104, 106 can include two or more plates substantially parallel to one another and configured to have edges of the divider 102 at least partially interposed therebetween. Although not shown, the guides 104, 106 can be flared outwards at their edges to facilitate maintenance of the divider 102, e.g., removal and/or insertion of the divider 102.

Figure 3:
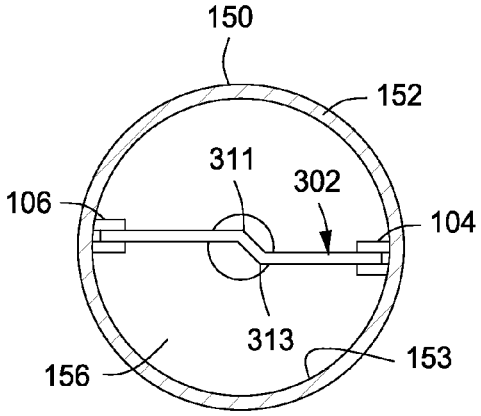
FIG. 3 depicts an alternative top view of the apparatus depicted in FIG. 1.

FIG. 3 depicts an alternative top view of the apparatus 100 depicted in FIG. 1. A divider 302 can include a single plate or sheet having one or more kinks, bends, and/or joints (two are shown 311, 313) and can be configured to be disposed between the guides 104, 106. The kinks 311, 313 in the divider 302 can facilitate flexing and/or bending thereof to compensate for changes to the dimensions of the housing 150 and/or the divider 302.

Figure 4:
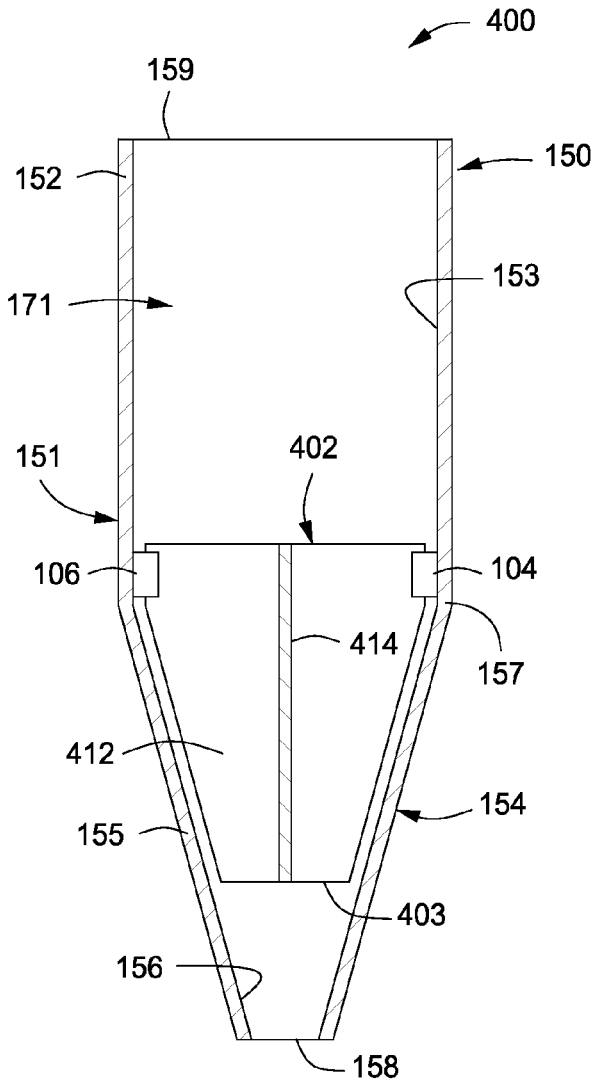
FIG. 4 depicts a cross-section view of another illustrative apparatus for reducing or preventing particulate bridging within a housing thereof, according to one or more embodiments described.

FIG. 4 depicts a cross-section view of another illustrative apparatus 400 for reducing or preventing particulate bridging in the housing 150, according to one or more embodiments. The apparatus 400 can be similar to the apparatus 100 discussed and described above with reference to FIGS. 1-3 and can include a divider 402 disposed within the housing 150. The divider 402 can include two or more plates or sheets (two are shown 412, 414). Similar to the divider 102, the divider 402 can extend from within the upper section 151 through the transition 157 and into the lower section 154 of the housing 150. For example, the plates 412, 414 can axially extend from the upper section 151 into the lower section 154. The divider 402 can be configured to have edges that fit or rest in the guides 104, 106 for support and/or stability thereof. Although not shown, it will be appreciated that the divider 402 can rest on the tapered walls of the lower section 154 with or without the guides 104, 106. The shape of each of the plates 412, 414 can each be of a similar or same shape as the divider 102, but can extend in at least one more direction within the internal volume 171 of the housing 150 by their combination, as compared to the divider 102.

A bottom or lower edge 403 of the divider 402 can extend, at least partially, into the lower section 154 of the housing 150. The lower edge 403 of the divider 402 can extend into the lower section 154 about 5% or more, about 10% or more, about 20% or more, about 30% or more, about 40% or more, about 50% or more, about 60% or more, about 70% or more, about 80% or more of a total length or height of the lower section 154. For example, the bottom or lower edge 403 of the divider 402 can extend about half way to about four-fifths of the way into the lower section 154. In one example, the lower edge 403 of the divider 402 can be disposed in lower section 154 proximate where the cross sectional area of the lower section 154 is about 2.5, about 2.7, about 2.9, about 3, about 3.1, about 3.3, about 3.5 times the cross-sectional area of the lowest point of the lower section 154, e.g., about three times the diameter of the outlet 158. In another example, the lower edge 403 of the divider 402 can extend to a point or location within the lower section 154 where a ratio of the cross-sectional area of the lower section 154 to the cross-sectional area of the outlet 158 is about 3:1 or less, about 2.5:1 or less, about 2:1 or less, or about 1.5:1 or less. Although not shown, the lower edge 403 of the divider 402 can extend all the way to the bottom of the lower section 154, i.e., all the way to the outlet 158. At least one of the plates 412, 414 of the divider 402 can extend from the upper section 152 to the lower section 154. Although not shown, an end or edge of a first plate 412 can extend further into the lower section 154 than an edge of a second plate 414. In another example, an end or edge of both of the plates 412, 414, respectively, can extend an equal distance into the lower section 154.

Figure 5:
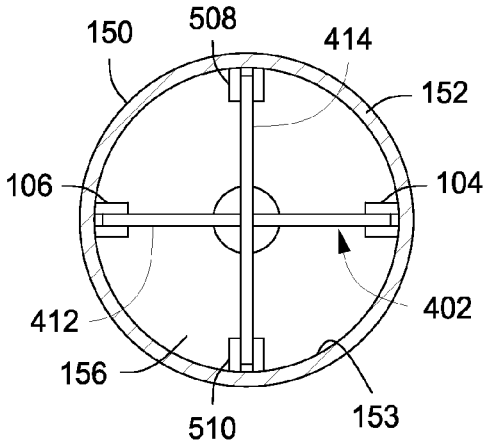
FIG. 5 depicts a top view of the apparatus depicted in FIG. 4.

FIG. 5 depicts a top view of the apparatus 400 depicted in FIG. 4. The first plate 412 can be disposed or otherwise secured across the second plate 414 to form four quadrants within the internal volume 171 of the housing 150. For example, the first plate 412 can be disposed substantially transverse or perpendicular the second plate 414. In another example, the first plate 412 can be disposed at an acute or obtuse angle with respect to the second plate 414. Although not shown, it will be appreciated that the two plates 412, 414 can be substituted with three or more plates that are secured (e.g., welded, bolted, screwed, riveted, or the like) together at a single central point. For example, four plates can be secured together at a central point to form the divider 402. In addition to the first and second guides 104, 106, one or more guides (two are shown 508, 510) can be disposed on or otherwise secured to the inner surface 153 of the upper wall 152, the inner surface 156 of the lower wall 155, or both. The guides 104, 106, 508, 510 can at least partially uphold and/or support the plates 412, 414 of the divider 402 and prevent the divider 402 from being dislodged during operation of apparatus 400. It will be appreciated, however, that the guides 104, 106, 508, 510, and/or additional guides (not shown) can be disposed on the inner surface 153 of the upper wall 152, the inner surface 156 of the lower wall 155, or both. Although not shown, it will be appreciated that the apparatus 400 can have no guides at all. For example, the divider 402 rest freely in the lower section 154 without any guides.

Figure 6:
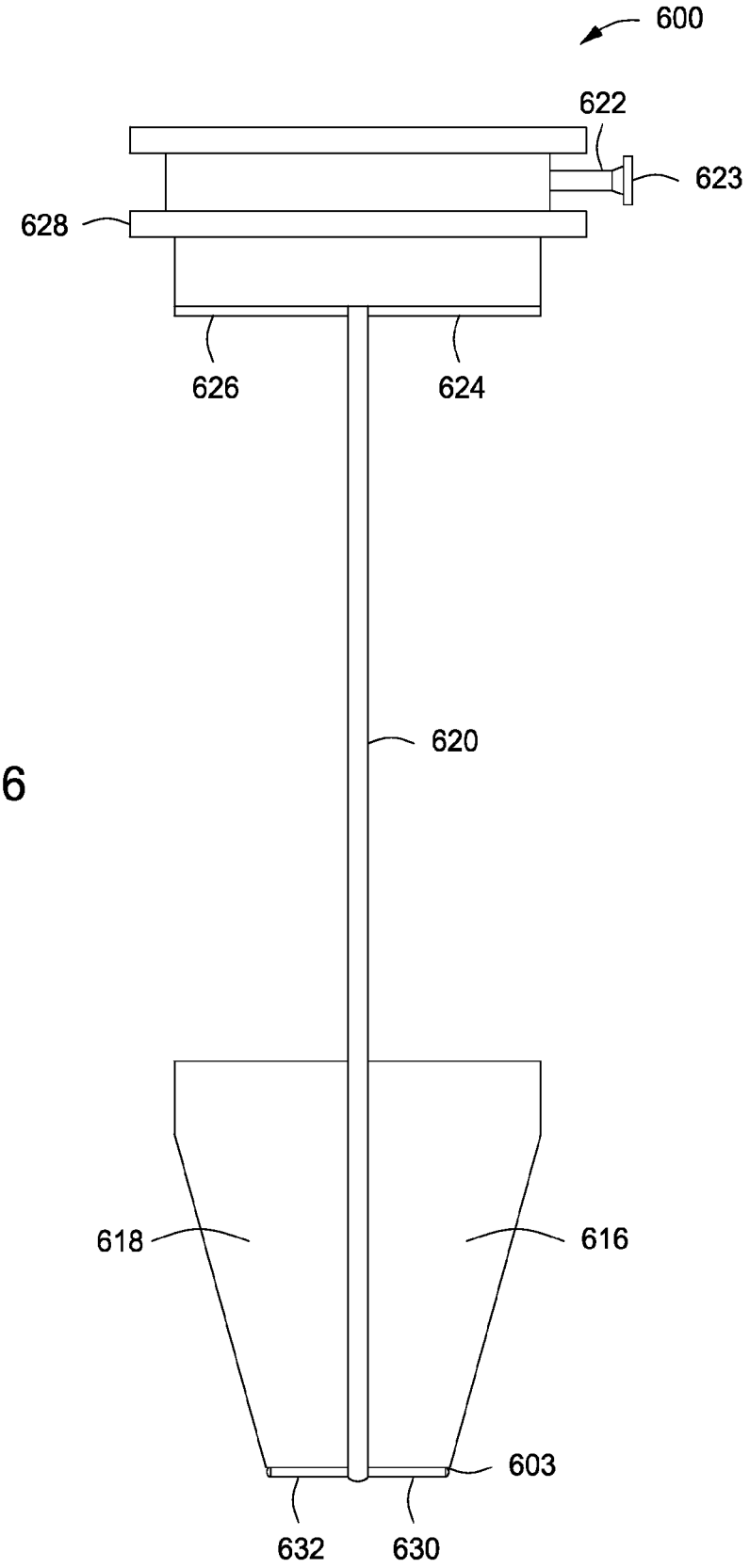
FIG. 6 depicts a side view of an illustrative divider, according to one or more embodiments described.

FIG. 6 depicts a side view of an illustrative divider 600, according to one or more embodiments. The divider 600 can include one or more plates or sheets (two are shown 616, 618) disposed on or otherwise secured to one or more pipes (one is shown 620). Although not shown, it will be appreciated that the divider 600 can be a single plate having one or more pipes secured thereto. The plates 616, 618 can extend radially from the pipe 620 and can, at least partially, extend along a portion of the pipe 620 in an axial direction with respect to the pipe 620. As illustrated, the plates 616, 618 can have five sides or edges—a first edge axially secured to the pipe 620, second and third edges (i.e., upper and lower edges) radially disposed with respect to the pipe 620 and substantially parallel to one another, a fourth edge substantially parallel to the pipe 620, and a fifth edge configured to be substantially parallel with a frustoconical or angled portion of a vessel or housing (not shown). It will be appreciated, however, that each of the divider plates 616, 618 can instead be, but is not limited to, a triangle, quadrilateral, rectangle, trapezoid, parallelogram, pentagon, heptagon, octagon, ellipse, circle, semi-circle, or the like. Although not shown, the plates 616, 618 can be triangular or trapezoidal, for example, to fit differently in a frustoconical or angled section of a vessel or housing. It will be appreciated that edges, angles, and orientation of the plates 616, 618 can vary to correspond, at least in part, with the shape of the vessel or housing in which they are meant to be disposed.

A hanger 628 can be disposed on or otherwise secured to a first or "upper" end 622 of the pipe 620, and the plates 616, 618 can be disposed on or otherwise secured to a second or "lower" end of the pipe 620. The hanger 628 can be configured to support the divider 600 and/or the pipe 620 within a housing (e.g., housing 150 in FIGS. 1-5) in which it can be placed. The hanger 628 can be joined to the pipe 620 via one or more supports (two are shown 624, 626). The supports or braces 624, 626 can extend radially from the pipe 620 and can be configured to at least partially position the pipe 620 within the housing (e.g., housing 150). The hanger 628 can sit on top or within the housing. For example, the hanger 628 can have a circular cross-section and can be adapted to connect with the top or first end of a housing having a similar sized circular cross section. In one example, the hanger 628 can be a spool piece configured to fit on or between flanges of a housing.

The upper end 622 of the pipe 620 can be disposed on or through the hanger 628 and can be adapted to connect to a fluid source either internal or external a vessel or housing. For example, the pipe 620 can have one or more bends proximate the upper end 622 such that the pipe 620 connects to or extends through a side or sidewall of the hanger 628. A nozzle 623 can be disposed at the end of the pipe 620 proximate the upper end 622, and can be disposed inside, outside, or through the hanger 628.

One or more fluid distribution or aeration conduits (two are shown 630, 632) can be disposed proximate the lower end of the pipe 620 and/or the lower edges of the plates 616, 618. The fluid distribution conduits 630, 632 can extend radially from the pipe 620. For example, the fluid distribution conduits 630, 632 can be disposed at two or more bottom edges of the plates 616, 618, respectively. Although not shown, additional fluid distribution conduits can be disposed on top edges of the plates 616, 618 and/or along sides or faces thereof. One or more aeration holes can be defined through a side of the pipe 620 and/or through sides of the fluid distribution conduits 630, 632. The one or more aeration holes can be configured to direct fluid along the plates 616, 618 and/or toward the sides and/or bottom of the housing in which the divider 600 can be placed. Illustrative fluids can include, but are not limited to, air, steam, nitrogen, carbon dioxide, argon, a liquid, or any combination thereof.

Figure 7:
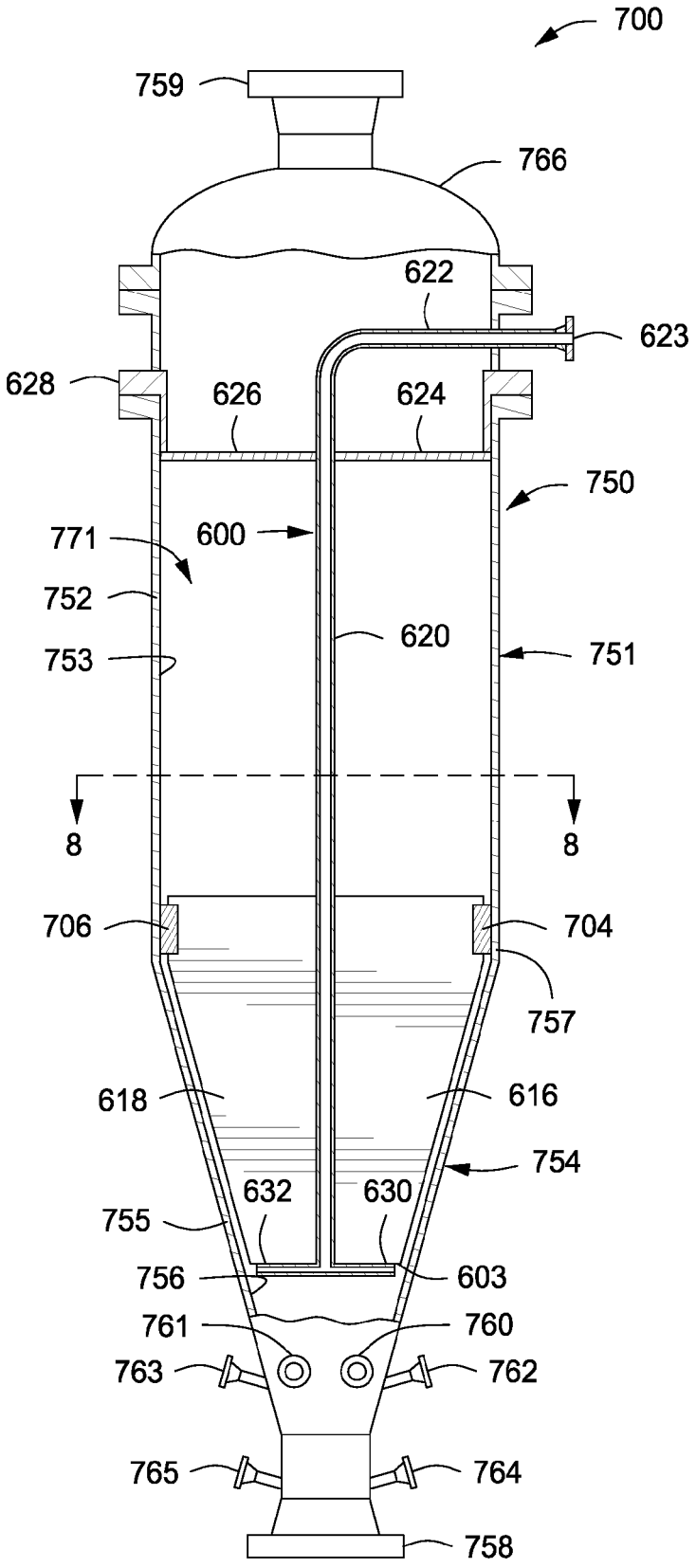
FIG. 7 depicts a partial cross-section view of yet another illustrative apparatus for reducing or preventing particulate bridging within a housing thereof having the divider depicted in FIG. 6 disposed therein, according to one or more embodiments described.

FIG. 7 depicts a partial cross-section view of an illustrative apparatus 700 for reducing or preventing particulate bridging in an illustrative vessel or housing 750 having the divider 600 depicted in FIG. 6 disposed therein, according to one or more embodiments. The housing 750 can be similar to the housing 150 described in FIGS. 1-5, and can be a lock hopper, for example. The housing 750 can include an upper section 751 and a lower section 754 that define an internal volume 771 within the housing 750. The lower section 754 can transition or taper from a cross-sectional area of the upper section 751 to a reduced cross-sectional area. For example, the upper section 751 can be cylindrical and the lower section 754 can be frustoconical, having a first diameter at a transition or transition point 757 where the lower section 754 joins the upper section 751 and a second diameter at a point distal the upper section 751. The first diameter can be larger than the second diameter. For example, the first diameter can be at least about two, about three, about four, or about five times larger than the second diameter.

Similar to the housing 150 in FIGS. 1 and 4, the upper section 751 can include one or more first or "upper" walls 752, and the lower section 754 can include one or more second or "lower" walls 755, where the upper wall 752 is disposed on or transitions to the lower wall 755. The upper wall 752 can be substantially parallel to a central axis of the housing 750. One or more inner sides or surfaces 756 of the lower wall 755 can slope inwardly and away from one of more inner sides or surfaces 753 of the upper wall 752. For example, at least one of the one or more inner surfaces 756 of the lower wall 755 can have an angle ranging from about 60°, about 65°, about 70° to a high of about 75°, about 80°, about 85° with respect to the central axis of the housing 750 and/or the upper wall 752.

The plates 616, 618 of the divider 600 can be axially disposed in the housing 750 and can extend from the upper section 751 into the lower section 754. One or more edges of the plates 616, 618 can be disposed proximate the one or more inner surfaces 753 of the upper wall 752, the one or more inner sides or surfaces 756 of the lower wall 755, or both. For example, one or more edges of the plates 616, 618 can be disposed in one or more guides 704, 706, respectively. The guides 704, 706 can be at least partially disposed on or otherwise secured to at least one of the one or more inner surfaces 753 of the upper wall 752 of the upper section 751 proximate the transition 757 from the upper section 751 to the lower section 754. It will be appreciated however, that the guides 704, 706 and/or additional guides (not shown) can be at least partially disposed on at least one of the one or more inner surfaces 756 of the lower wall 755 of the lower section 754. The first and second guides 704, 706 can be secured or fastened to the housing 750 by one or more welds, nuts and bolts, rivets, screws, nails, epoxy, any other suitable fastener, or any combination thereof. The first and second guides 704, 706 can at least partially uphold, align, and/or support the divider 600 and can at least partially prevent the divider 600 from being dislodged during operation of apparatus 700.

A first edge of each plate 616, 618 can be disposed substantially parallel to the upper wall 752 of the upper section 751, and a second edge of each plate 616, 618 can be disposed substantially parallel to the lower wall 755 of the lower section 754. A lower edge 603 of the divider 600 (e.g., a lower edge of the plates 616, 618) can at least partially extend into the lower section 754 of the housing 750. For example, the lower edge 603 of the divider 600 can extend into the lower section 754 about 5% or more, about 10% or more, about 20% or more, about 30% or more, about 40% or more, about 50% or more, about 60% or more, about 70% or more, about 80% or more of a total length or height of the lower section 754. In another example, the lower edge 603 of the divider 600 can extend about half way to about four-fifths of the way into the lower section 754. In one example, lower edges of the plates 616, 618 can be disposed in the lower section 754 proximate where the cross sectional area of the lower section 754 is about 2.5, about 2.7, about 2.9, about 3, about 3.1, about 3.3, about 3.5 times the cross-sectional area of the lowest point of the lower section 754, e.g., the outlet 758. Although not shown, the lower edge of the plates 616, 618 can extend all the way to the bottom of the lower section 754, i.e., proximate the outlet 758.

The housing 750 can include one or more inlets (one is shown 759) disposed on a first or "upper" end of the housing 750 and an outlet 758 disposed proximate a second or "bottom" end of the housing 750 and/or the lower section 754. The inlet 759 can be disposed on a cap or "top section" 766 for the housing 750. The outlet 758 can be or include one or more nozzles and can be configured to be in fluid communication with another apparatus or vessel. One or more aeration nozzles (six are shown 760-765) can be disposed on the lower section 754 proximate the outlet 758. For example, the aeration nozzles 760-765 can be located on the outside of the lower section 754 between bottom edges of the plates 616, 618 and/or the pipe 620 of the divider 600 and the outlet 758 of the housing 750. The aeration nozzles 760-765 can be in fluid communication with the inside of the housing 750 and/or the lower section 754.

The hanger 628 of the divider 600 can be disposed between and/or otherwise secured to the cap 766 and the upper section 751 of the housing 750. For example, the hanger 628 can have a first flanged edge that corresponds to a flanged edge of the cap 766 and a second flanged edge that corresponds to a flanged edge of the upper section 751. The matching flanges can be secured via one or more fasteners (not shown) to secure the hanger 628 to the housing 750. Suitable fasteners can include, but are not limited to, one or more welds, nuts and bolts, rivets, screws, nails, epoxy, or any combination thereof. In another example, the hanger 628 can be removably fastened to the upper section 754. The hanger 628 and/or the supports 624, 626 can position the pipe 620 within the housing 750. For example, the supports 624, 626 can center the pipe 620 within the housing 750. The upper end 622 of the pipe 620 can at least partially extend through an end of the housing 750 and at least partially through a sidewall of the hanger 628 such that the nozzle 623 protrudes from the side of the hanger 628 and/or the sidewall of the housing 750. In another example, the pipe 620 can be in fluid communication with the nozzle 623.

In order to locate and/or position the divider 600 in the housing 750, the cap 766 can be removed from the housing 750 and the divider 600 can be disposed into the housing 750. The divider 600 can be positioned so that one or more edges of the plates 616, 618 are proximate the internal sidewall of the housing 750. For example, one or more edges of the plates 616, 618 can be positioned to rest on the internal sidewall of the housing 750 and/or in at least one of the guides 704, 706.

Figure 8:
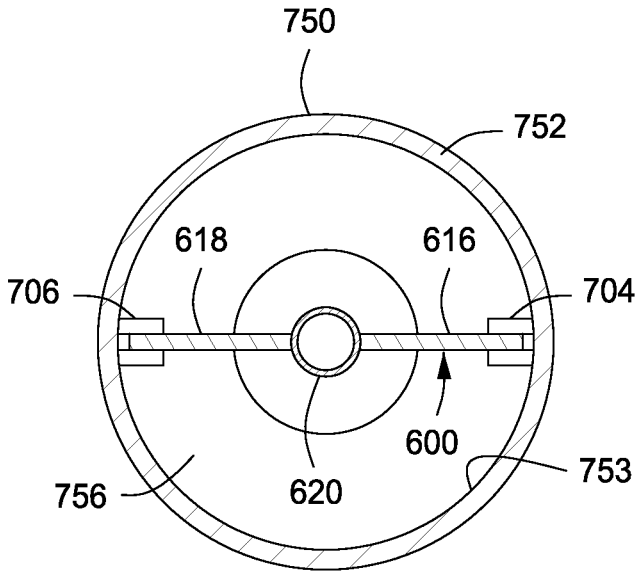
FIG. 8 depicts a cross-section view of the apparatus depicted in FIG. 7 along line 8-8, according to one or more embodiments described.

FIG. 8 depicts a cross-section view of the housing 750 and the divider 600 depicted in FIG. 7 along line 8-8, according to one or more embodiments. The plates 616, 618 can be disposed radially from the pipe 620 toward the one or more inner surfaces 753 of the upper wall 752, the one or more inner surfaces 756 of the lower wall 755, or both. The plates 616, 618 can extend from the pipe 620 such that edges of the plates 616, 618 are disposed within the guides 704, 706, respectively. The edges of the plates 616, 618 can be parallel one another and can each extend from the pipe 620 to the guides 704, 706 disposed on the inner surface 753 of the upper wall 752, the inner surface 756 of the lower wall 755, or both. The pipe 620 can be centered between the two plates 616, 618 or off-center, as desired.

Figure 9:
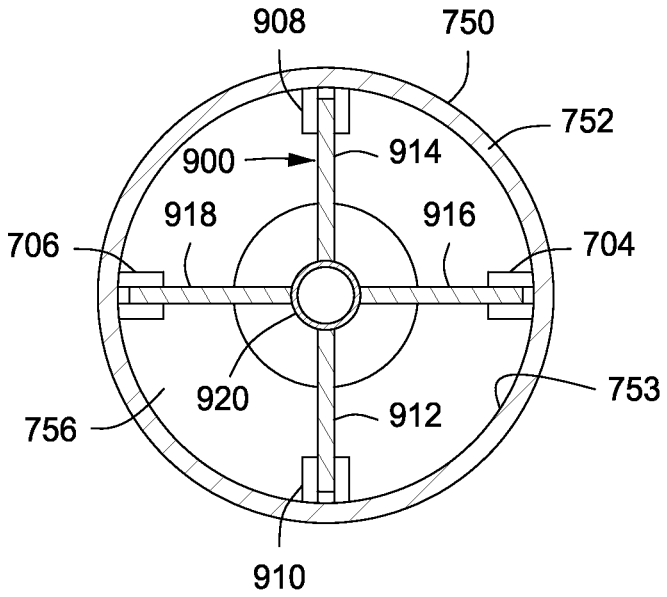
FIG. 9 depicts a cross-section view of an alternative illustrative divider disposed within the housing depicted in FIG. 7, according to one or more embodiments described.

FIG. 9 depicts a cross-section view of an alternative illustrative divider 900 disposed in the housing 750 depicted in FIG. 7, according to one or more embodiments. One or more plates (four are shown 912, 914, 916, 918) can extend from a pipe 920. For example, the plates 912, 914, 916, 918 can be disposed radially from the pipe 920 toward the one or more inner surfaces 753 of the upper wall 752, the one or more inner surfaces 756 of the lower wall 755, or both. As illustrated, the plates 912, 914, 916, 918 can be equally spaced apart, e.g., having equal angles therebetween. It will be appreciated, however, that the plates 912, 914, 916, 918 can be set at other angles with varying or non-uniform spacing therebetween.

The plates 912, 914, 916, 918 can extend from the pipe 920 to one or more guides (four are shown 704, 706, 908, 910) and can aid positioning of the pipe 920 in the housing 750. For example, the plates 912, 914, 916, 918 and/or the guides 704, 706, 908, 910 can position the pipe 920 approximately in the center of the housing 750. Like the guides 704, 706, the guides 908, 910 can be disposed on the one or more inner surfaces 753 of the upper wall 752, the one or more inner surfaces 756 of the lower wall 755, or both. The guides 908, 910, in conjunction with the guides 704, 706, can at least partially uphold and/or support the divider 900 and at least partially prevent it from being dislodged during operation of apparatus 700.

Figure 10:
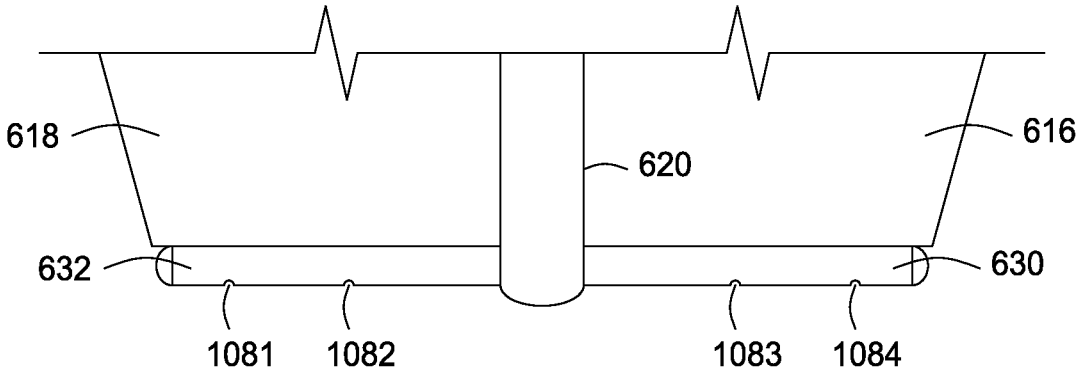
FIG. 10 depicts a partial side view of illustrative fluid distribution conduits of the divider depicted in FIGS. 6 and 7, according to one or more embodiments described.

FIG. 10 depicts a partial side view of illustrative fluid distribution conduits 630, 632 of the divider 600 depicted in FIGS. 6 and 7, according to one or more embodiments. As discussed and described above, the one or more fluid distribution conduits 630, 632 can be disposed at a bottom end of the pipe 620 and/or edges of the plates 616, 618. The fluid distribution conduits 630, 632 can extend radially from the pipe 620. The fluid distribution conduits 630, 632 can have one or more aeration holes (four are shown 1081, 1082, 1083, 1084) defined through sidewalls thereof and configured to direct fluid, e.g., air, from the pipe 620 into the second section 754 of the housing 750, the outlet 758 of the housing 750, and/or along the plates 616, 618. As illustrated, the aeration holes 1081, 1082, 1083, 1084 can be configured to direct fluid toward the outlet 758 of the housing 750. It will be appreciated, however, that the aeration holes 1081, 1082, 1083, 1084 or other aeration holes can be configured to direct fluid in a variety of angles including, but not limited to, angles ranging from about 15° to about 90° from the axial direction of the housing 750.

Figure 11:
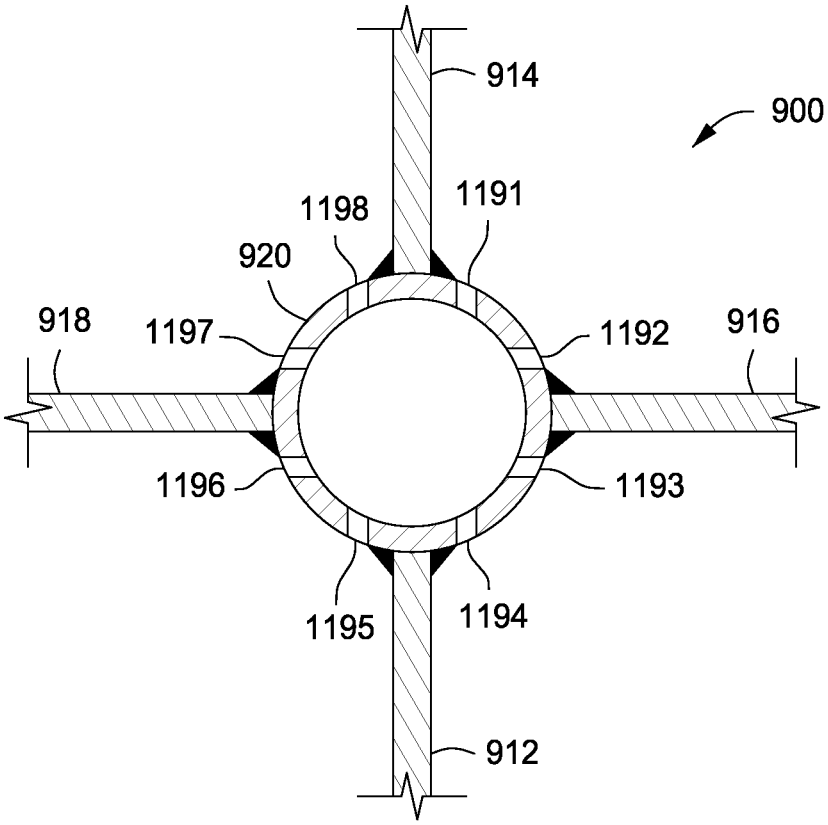
FIG. 11 depicts a close-up partial cross-section view of the divider depicted in FIG. 7, according to one or more embodiments described.

FIG. 11 depicts a close-up partial cross-section view of the divider 900 depicted in FIG. 9, according to one or more embodiments. The four plates 912, 914, 916, 918 can be disposed about the pipe 920. One or more aeration holes (eight are shown 1191-1198) can be disposed about and defined through one or more sides or sidewalls of the pipe 920, in between the plates 912, 914, 916, 918. For example, two aeration holes can be formed, disposed, or defined through the sidewall of the pipe 920 between each of the plates 912, 914, 916, 918. It will be appreciated that more or less aeration holes can be disposed through or defined through the sidewall of the pipe 920. The aeration holes 1191-1198 can be configured to direct fluid, e.g., air, from the pipe 920 along the plates 912, 914, 916, 918. For example, the aeration holes 1191-1198 defined through the sides of the pipe 920 can be configured to direct air along sides or faces of the plates 912, 914, 916, 918 in an angled direction, e.g., a direction of mass flow, to at least partially break up any particulate bridge or partial bridge that may have formed in the housing 750.

Referring to FIGS. 1-11, in operation the apparatus 700 can assist mass flow through the housing 750 by reducing or preventing particulate bridging between the walls thereof with the divider 600. It will be appreciated that the dividers 102, 302, and 402 can function in the housing 150 in a same or similar manner as the dividers 600 and 900 in the housing 750. For simplicity, however, only the functioning of the apparatus 700 with the divider 600 is briefly described.

In operation, particulates can be introduced to a first end of the housing 750 and dispensed from a second end of the housing 750. For example, particulates can be introduced to the inlet 759 of the housing 750 and dispensed from the outlet 758. The divider 600 can be disposed in the internal volume 771 of the housing 750 and extend from the upper section 751 to about halfway or more into the lower section 754 to reduce or prevent bridging within the vessel. For example, the apparatus 700 with the divider 600 disposed in the housing 750 can reduce particulate bridging at the transition between the upper sections 751 and the lower sections 754. The walls of the plates 616, 618 can be positioned in the housing 750 to split or divide an angle between the lower wall or walls 755 of the lower section 754, thereby limiting particulate bridging therebetween. The walls of the plates 616, 618 can be vertical to at least partially remove an anchor point for particulate bridges to form between the lower wall or walls 755 of the lower section 754 and the walls of the plates 616, 618, i.e., preventing a particle bridge "keystone" from completing a particle bridge. The verticality of the walls of the plates 616, 618 can minimize particle adhesion to the walls to only frictional forces, thereby reducing, limiting, and/or preventing particulate bridging within the housing 750. In addition, a low-friction finish or polish on the plates 616, 618 of the divider 600 can reduce or prevent particulates from adhering to the plates 616, 618, further reducing the probability or likelihood of a particulate bridge forming in the housing 750.

If particulate bridging begins to occur or does occur, fluid, e.g., air, can be introduced to the housing 750 via the pipe 620, aeration holes 1081-1084 in the fluid distribution conduits 630, 632, and/or aeration holes 1191-1198 in the pipe 620. For example, if particulate bridging occurs between a lower edge of the divider 600 and the outlet 758, air from the fluid distribution conduits 630, 632 via the aeration holes 1081-1084 can urge and/or agitate bridged particulates, thereby collapsing the bridge. In another example, the aeration holes 1191-1198 in the pipe 620 can direct air along at least one of plates 616, 618 to collapse or break particulate bridges or partial bridges that may have formed therebetween and/or between the plates 616, 618 and the inner surface 756 of the lower wall 755.

Embodiments of the present disclosure further relate to any one or more of the following paragraphs:

1. An apparatus for mass flow, comprising: a housing; an inlet disposed at a first end of the housing; an outlet disposed at a second end of the housing, wherein the housing comprises a first section and a second section, wherein the second section has at least one tapered sidewall that slopes away from an inner surface of the first section toward the outlet; and a divider disposed at least partially within the first and second sections of the housing, wherein the divider has at least one tapered surface disposed proximate the at least one tapered sidewall of the second section, and wherein an edge of the divider is located between the outlet and a point within the second section where a ratio of a cross-sectional area of the second section to a cross-sectional area of the outlet is about 3:1 or less.

2. The apparatus of paragraph 1, wherein the inner surface of the first section is a cylindrical inner surface and an inner surface of the second section is a frustoconical inner surface.

3. The apparatus of paragraphs 1 or 2, wherein the at least one tapered sidewall of the second section slopes at an angle ranging from about 60° to about 85° with respect to a longitudinal central axis of the housing.

4. The apparatus according to any one of paragraphs 1 to 3, wherein the divider comprises a plate.

5. The apparatus of paragraph 4, wherein one or more edges of the plate are disposed within one or more guides, wherein each of the one or more guides comprises two or more parallel plates protruding from the inner surfaces of the first section, an inner surface of the second section, or both, and wherein the one or more guides are configured to align the divider within the first and second sections.

6. The apparatus of paragraphs 4 or 5, wherein the plate has one or more kinks.

7. The apparatus according to any one of paragraphs 1 to 6, wherein the divider comprises a first plate disposed transverse to a second plate.

8. The apparatus according to any one of paragraphs 1 to 7, wherein a first edge of the divider is disposed within the first section and a second edge of the divider is disposed within the second section, and wherein the first and second edges are parallel to one another.

9. The apparatus according to any one of paragraphs 1 to 8, wherein the divider comprises one or more plates radially extending from a pipe.

10. The apparatus of paragraph 9, wherein the divider comprises four plates disposed radially from the pipe toward the inner surface of the first section, an inner surface of the second section, or both, and wherein the pipe is approximately centered within the housing.

11. An apparatus for mass flow, comprising: a housing; an inlet disposed at a first end of the housing; an outlet disposed at a second end of the housing, wherein the housing comprises a first section and a second section, wherein the first section has a cylindrical inner surface and the second section has a frustoconical inner surface; and a divider disposed at least partially within the first and second sections of the housing, the divider comprising: one or more plates radially extending from a pipe, wherein an edge of the one or more plates is located between the first section and a point in the second section where a ratio of a diameter of the second section to a diameter of the outlet is about 3:1 or less; and at least one tapered surface disposed proximate the frustoconical inner surface of the second section.

12. The apparatus of paragraph 11, wherein the divider comprises four plates disposed radially from the pipe toward the cylindrical inner surface of the first section, the frustoconical surface of the second section, or both.

13. The apparatus of paragraphs 11 or 12, further comprising one or more fluid distribution conduits extending from the pipe.

14. The apparatus of paragraph 13, wherein two or more fluid distribution conduits extend radially from the pipe along edges of two or more of the plates.

15. The apparatus of paragraph 14, wherein the fluid distribution conduits have one or more aeration holes defined through sidewalls thereof configured to direct fluid into the second section of the housing.

16. The apparatus according to any one of paragraphs 11 to 15, further comprising a cylindrical hanger disposed proximate the first end of the housing, wherein the pipe extends through the first end of the housing and through a sidewall of the hanger.

17. The apparatus according to any one of paragraphs 11 to 16, wherein the pipe has one or more aeration holes defined through sidewalls thereof, wherein the one or more aeration holes are configured to direct fluid along sides of the one or more plates.

18. A method for preventing particulates from bridging in a vessel for mass flow, comprising: disposing a divider in an internal volume of a housing, wherein the divider extends from a cylindrical first section of the housing to a point in a frustoconical second section of the housing where a ratio of a diameter of the second section to a diameter of an outlet to the housing is about 3:1 or less, wherein the divider has at least one tapered surface disposed proximate a sidewall of the second section, and wherein the divider comprises a plate; introducing particulates to a first end of the housing; and dispensing the particulates from the outlet of the housing.

19. The method of paragraph 18, further comprising directing a fluid through a pipe disposed on the divider and through aeration holes defined through a sidewall of the pipe.

20. The method of paragraph 19, further comprising directing the fluid toward a second end of the housing through one or more fluid distribution conduits radially disposed at an end of the pipe.

As used herein, the terms "up" and "down;" "upward" and "downward;" "upper" and "lower;" "upwardly" and "downwardly;" "above" and "below;" and other like terms refer to relative positions to one another and are not intended to denote a particular spatial orientation since the apparatus and methods of using the same can be equally effective at various angles or orientations.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure may be devised without departing from the basic scope thereof, and the scope thereof is determined by the claims that follow.

What is claimed is:

1. An apparatus of mass flow, comprising:

a housing having an inlet, an outlet, an internal volume, and a first section that transitions to a tapered second section;

a pipe disposed in the internal volume, the pipe having a first end extending through a wall of the first section and a second end that extends axially along the internal volume, the second end having at least one fluid distribution conduit in which at least one aeration hole is formed; and a divider that includes at least one plate extending from the pipe, the at least one plate disposed at least partially within the first section and the second section of the housing, wherein the plate has at least one tapered surface disposed adjacent to at least one tapered sidewall of the second section.

2. The apparatus of claim 1, wherein an inner surface of the first section is a cylindrical inner surface and an inner surface of the second section is a frustoconical inner surface, wherein the second section transitions from a cross-sectional area of the first section to a reduced cross-sectional area at the outlet, and wherein a side of the divider is secured to at least one of: (i) the inner surface of the first section, and (ii) the inner surface of the second section.

3. The apparatus of claim 1, wherein the at least one tapered sidewall of the second section slopes at an angle ranging from about 60° to about 85° with respect to a longitudinal central axis of the housing, wherein the divider extends from a first location on an inner surface of the second section to a second location on the inner surface of the second section.

4. The apparatus of claim 1, wherein one or more edges of the at least one plate are disposed within one or more guides, wherein each of the one or more guides comprises two or more parallel plates protruding from the inner surfaces of the first section, an inner surface of the second section, or both, and wherein the one or more guides are configured to align the divider within the first and second sections.

5. The apparatus of claim 1, wherein the at least one plate comprises a first plate disposed transverse to a second plate.

6. The apparatus of claim 1, wherein the divider comprises four plates disposed radially from the pipe to one of: (i) a location adjacent to an inner surface of the first section, (ii) to a location adjacent to an inner surface of the second section, and wherein the pipe is approximately centered within the housing.

7. The apparatus of claim 1, wherein the at least one fluid distribution conduit is positioned to direct air along a horizontal edge of the at least one plate, the horizontal edge being disposed in the second section.

8. The apparatus of claim 1, wherein the divider includes a plurality of plates extending from the pipe, each plate being disposed at least partially within the first section and the second section of the housing, wherein each plate has at least one tapered surface disposed adjacent to the at least one tapered sidewall of the second section.

9. The apparatus of claim 1, wherein the divider centers the pipe in the housing and the is pipe supported in the internal volume by one of (i) a hanger disposed in the upper section, and (ii) a support disposed in the upper section.

10. The apparatus of claim 1, further comprising a guide disposed on the sidewall of the second section and supporting the at least one plate.

* * * * *